US005082143A

United States Patent [19]

Schramm, Jr.

[11] Patent Number: 5,082,143

[45] Date of Patent: Jan. 21, 1992

[54] AUTOMATIC CONTROL SYSTEM FOR ACCURATELY DISPENSING MIXED DRINKS

[76] Inventor: William L. Schramm, Jr., 5984 Steubenville Pike, McKees Rocks, Pa. 15136

[21] Appl. No.: 534,167

[22] Filed: Jun. 6, 1990

[51] Int. Cl.[5] ..... B67D 5/00

[52] U.S. Cl. ..... 222/66; 222/129.1

[58] Field of Search ..... 222/1, 66, 57, 129.1, 222/129.2

[56] References Cited

U.S. PATENT DOCUMENTS

| | | | |
|---|---|---|---|
| 2,547,423 | 4/1957 | Wegman et al. | 222/129.2 |
| 2,566,436 | 9/1951 | Waite | 222/129.2 |
| 3,055,551 | 9/1962 | Johnson | 222/66 |
| 3,140,012 | 7/1964 | Hansen | 222/66 |
| 3,348,737 | 10/1967 | Yingst et al. | 222/129.2 |
| 3,460,717 | 8/1969 | Thomas | 222/129.1 R |
| 3,465,915 | 9/1969 | de Harde | 222/66 |
| 3,537,616 | 8/1968 | Diebel et al. | 222/66 |
| 3,981,414 | 9/1976 | Gust et al. | 222/38 |
| 4,544,328 | 10/1985 | Credle | 417/33 |
| 4,632,275 | 12/1986 | Parks | 222/66 X |
| 4,687,120 | 8/1987 | McMillin | 222/129.1 X |
| 4,753,370 | 6/1988 | Rudick | 222/105 |
| 4,795,061 | 1/1989 | Peckjian | 222/66 |
| 4,856,676 | 8/1989 | Emody | 222/66 R |
| 4,960,228 | 10/1990 | Takahashi et al. | 222/129.1 R |

FOREIGN PATENT DOCUMENTS 0272159 6/1988 European Pat. Off. ..... 222/129.1

*Primary Examiner*—Michael S. Huppert
*Assistant Examiner*—Anthoula Pomrening
*Attorney, Agent, or Firm*—David V. Radack

[57] ABSTRACT

A compact and smoothly working, principally electrically controlled beverage mixing and dispensing system is provided in which water or carbonated water is supplied as the principle ingredient and one or more, usually two, sub-ingredients, such as syrup, flavoring extracts, sweeteners, etc. are to be separately supplied in selected, regulated amounts, mixed therewith and then discharged into a suitable drink container. Pumps illustrated are fluid pressure (carbon dioxide) operated to supply the sub-ingredients to individual electric switches and then through individual regulators and electric solenoid-controlled valves into a common mixing and drink dispensing chamber. Each electric switch is fluid pressure sensitive and normally closed to energize the solenoids and open their associated valves when a positive pressure flow of a liquid ingredient is being supplied from a suitable source; and each switch is opened when a fall-off or negative fluid pressure is applied thereto due to a depletion or shut-off of flow of any one of the ingredients, and is employed to, when moved to an "open" position, simultaneously cause a de-energization of all the solenoids, a closing of their associated valves and a stoppage of any feed of ingredients into the mixing chamber.

8 Claims, 5 Drawing Sheets

AUTOMATIC CONTROL SYSTEM FOR ACCURATELY DISPENSING MIXED DRINKS

This invention relates to an apparatus for dispensing liquid drinks and the like, wherein a carrier such as water or carbonated water is to be mixed or impregnated with numerous liquid-like substances for adding flavor, body, color, etc. thereto and provide a suitable mixed drink.

BACKGROUND OF THE INVENTION

There have been numerous and varied types of liquid dispensing systems for filling beverage containers which, for the most part, employ relatively complex operating arrangements and control elements, but to my knowledge, none of them meet the need for a relatively simple, positive acting and highly efficient system for meeting a long standing problem in the art. This problem has arisen in connection with a so-called bag supplied ingredient system wherein water, as such, carbonated water or salt free water is supplied by a pressurized line to a dispensing station, and liquid ingredients are separately supplied from individual, chemically inert container bags. Each bag usually has a capacity of about two to five gallons of liquid. At the dispensing station, the water and the usual other two liquid ingredients, namely the syrup and the sweetener are mixed by adjustable regulators in proportioned amounts in accordance with a desired formula, and then the mixture is fed into a drinking cup or container for the customer's use.

After a period of use, although the owner of the dispensing unit may try to provide a content of each of the liquid ingredient containing bags roughly corresponding to the proportions of the desired mix, one bag will become exhausted before another, usually the syrup, with the result that one or more ingredients will be lost from the dispensing content. Also, the proprietor may desire to change the mixing proportions and ingredients from time to time. There is, thus, an important need for, in some way, immediately fully stopping the mixing and dispensing operation to enable a replacement bag to be installed before any further dispensing occurs. In other words, the entire operation should positively and immediately be stopped in order that the customer will not be disappointed with a deficient drink content and thus become a candidate for a competitor's product.

The need has also been to accomplish such a type of operational control in such a manner as to avoid an increase in dispensing unit apparatus size or space requirements, and also, in such a manner as to avoid the need for and the expense of replacing presently available or installed dispensing equipment or its operating elements.

Heretofore, the approach has been to, in some way, redesign the apparatus elements, thereby necessitating, discarding and replacing or enlarging a present equipment set-up in such a manner as to not only become highly complex and expensive, but also as to contravene installation limited space requirements.

In this connection, one approach was to provide extra bag or container units and then when one bag is emptied, to switch connections from the empty unit to a full unit. This not only takes up additional space, but requires a more complex system of operating elements, and especially when two or more types of liquids are required for the mixing operation. See the Hansen U.S. Pat. No. 3,140,012 and the Johnson U.S. Pat. No. 3,055,551. Also, there has been single ingredient or premixing mixed drink dispensing equipment that shuts-off when, for example, there is not a sufficient, full cup or serving, see the Gust, et al. U.S. Pat. No. 3,981,414. The problem solved by my invention is represented by the space wasting equipment devised for only independently controlling each of a series of liquid dispensing units, see U.S. Pat. of Diebel, et al. No. 3,537,616. The Harde U.S. Pat. No. 3,465,915 is also representative of a system involving the same problem.

SUMMARY OF THE INVENTION

It has thus been an object of my invention to solve the above problem and prevent any so-called miss-mixes at a liquid drink dispensing station, and to do so without any time delay and, in an immediate and positive manner.

Another object has been to meet the further problem of enabling an improved type of operation without requiring an impractical enlargement of the space requirements of existing dispensing units and particularly, to enable an inexpensive and relatively easy adaption of presently available liquid dispensing apparatus without the expense of discarding, greatly enlarging or replacing presently used apparatus or operating units.

A further object has been to devise a fool-proof and relatively simple operating system for only mixing and dispensing a full and desired ingredients-proportioned content for a mixed drink.

These and other objects of my invention will be apparent to those skilled in the art from the description herein set forth.

The foregoing problems and the above objects have been met by providing an operating system in which electric power for actuating of individual solution dispensing solenoid-operated valves is routed through a group of fluid pressure-sensitive switches in such a manner that all operational units may be simultaneously de-energized and all liquid material mixing and feeding units will be immediately, positively and simultaneously de-energized when any one of the supply sources becomes exhausted as to it's content. It will be noted that the use of separate supply sources is highly important, since separation, adverse chemical and flavor effects, staleness, etc. occur with factory pre-mixing of, for example, a syrup with sweetening extract.

Figure 5:
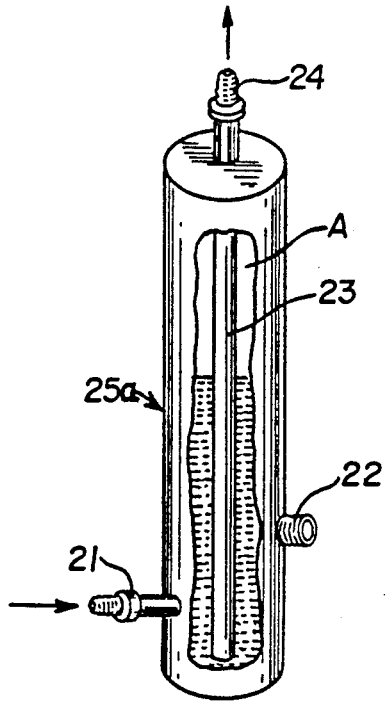
Figure 3:
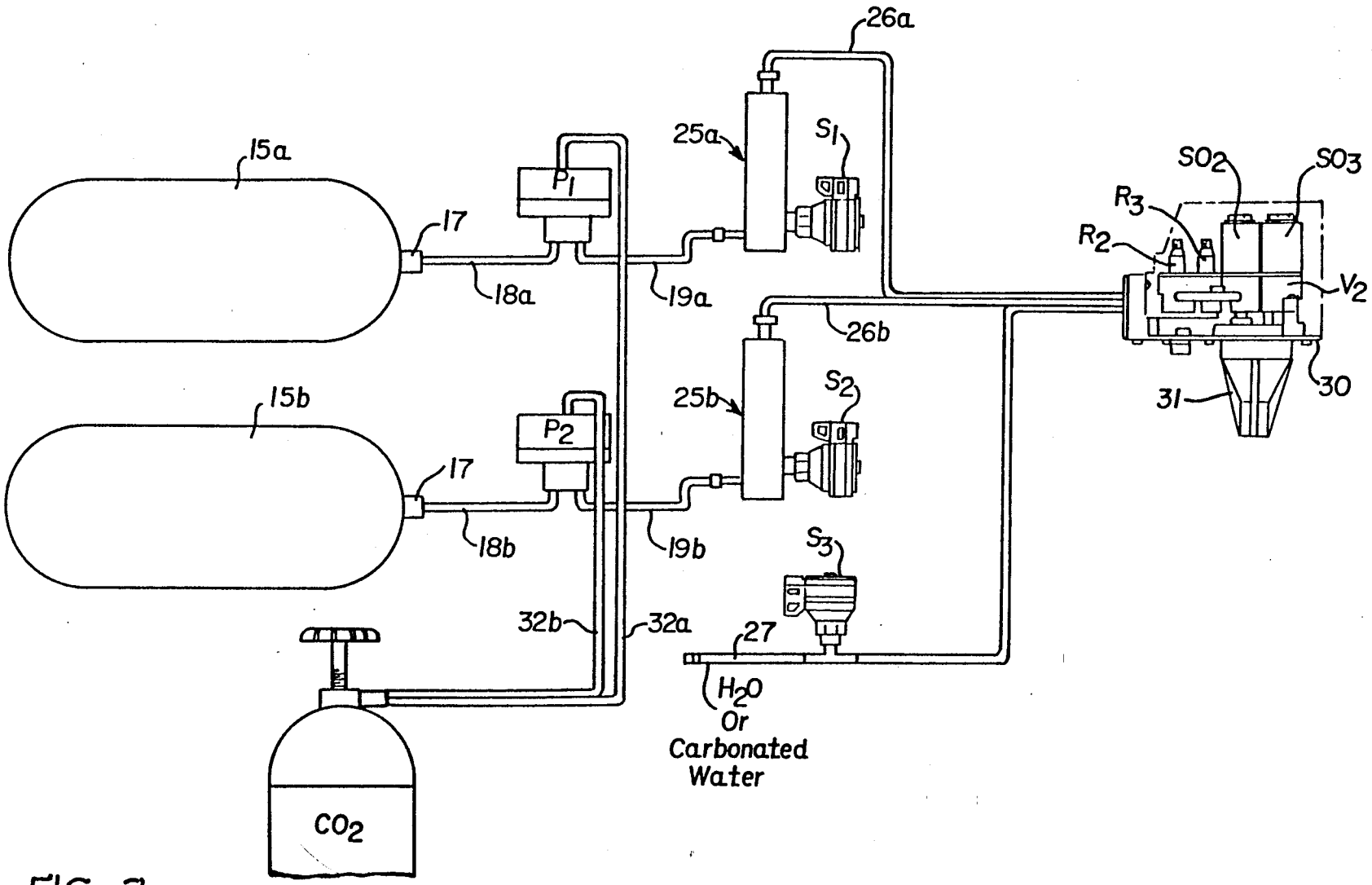
FIG. 3 is a slightly enlarged side view in elevation showing equipment units in an operating layout employed in accordance with my invention.
Figure 4:
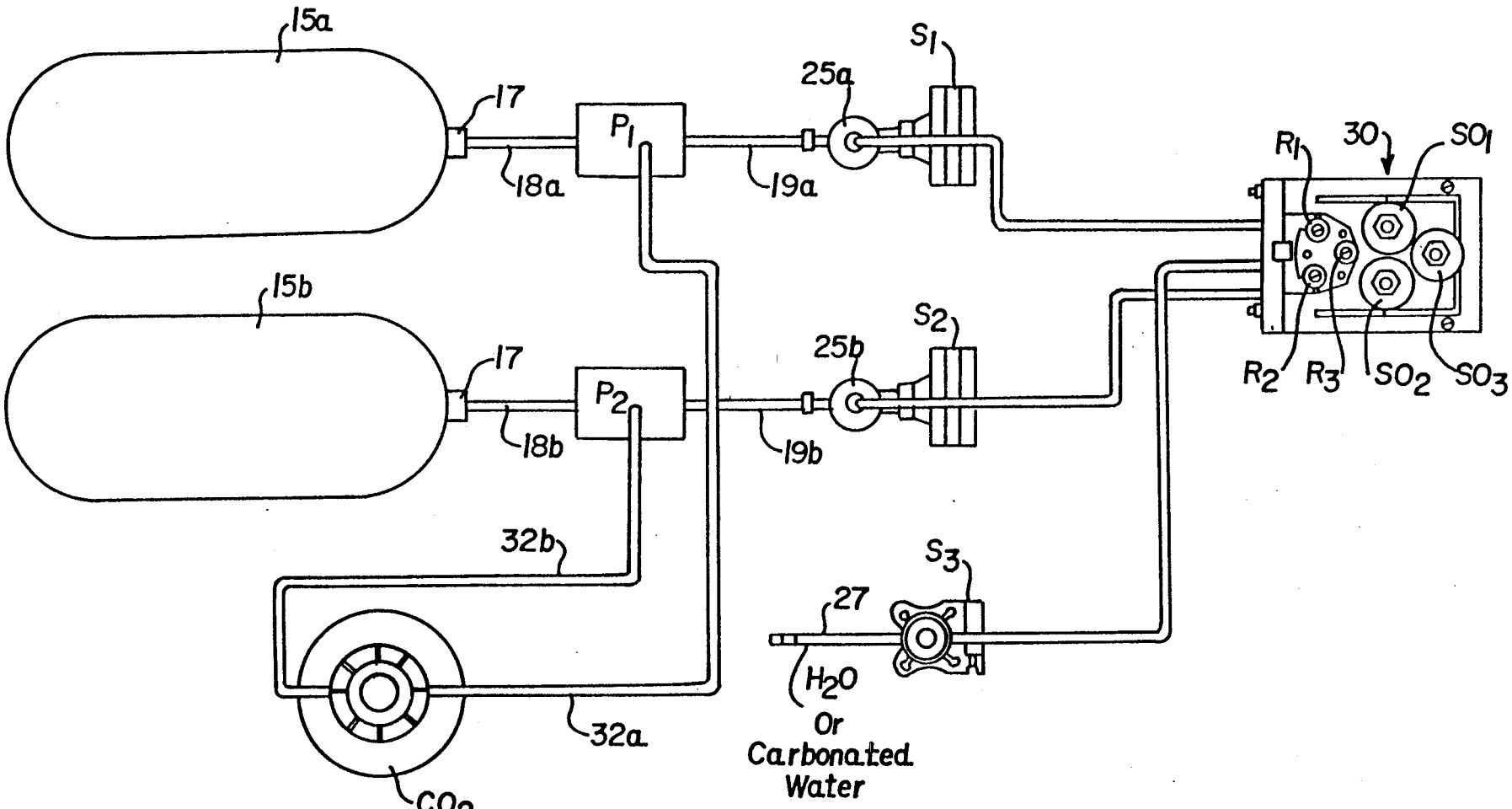
FIG. 4 is a top plan view on the scale of and showing the same representative equipment units as FIG. 3 that may be adapted for use in my system.

And, FIG. 5 is a slightly enlarged view in vertical elevation of a stabilizing unit desired by me that is shown as being employed in the operating layout of FIGS. 3 and 4.

Figure 1:
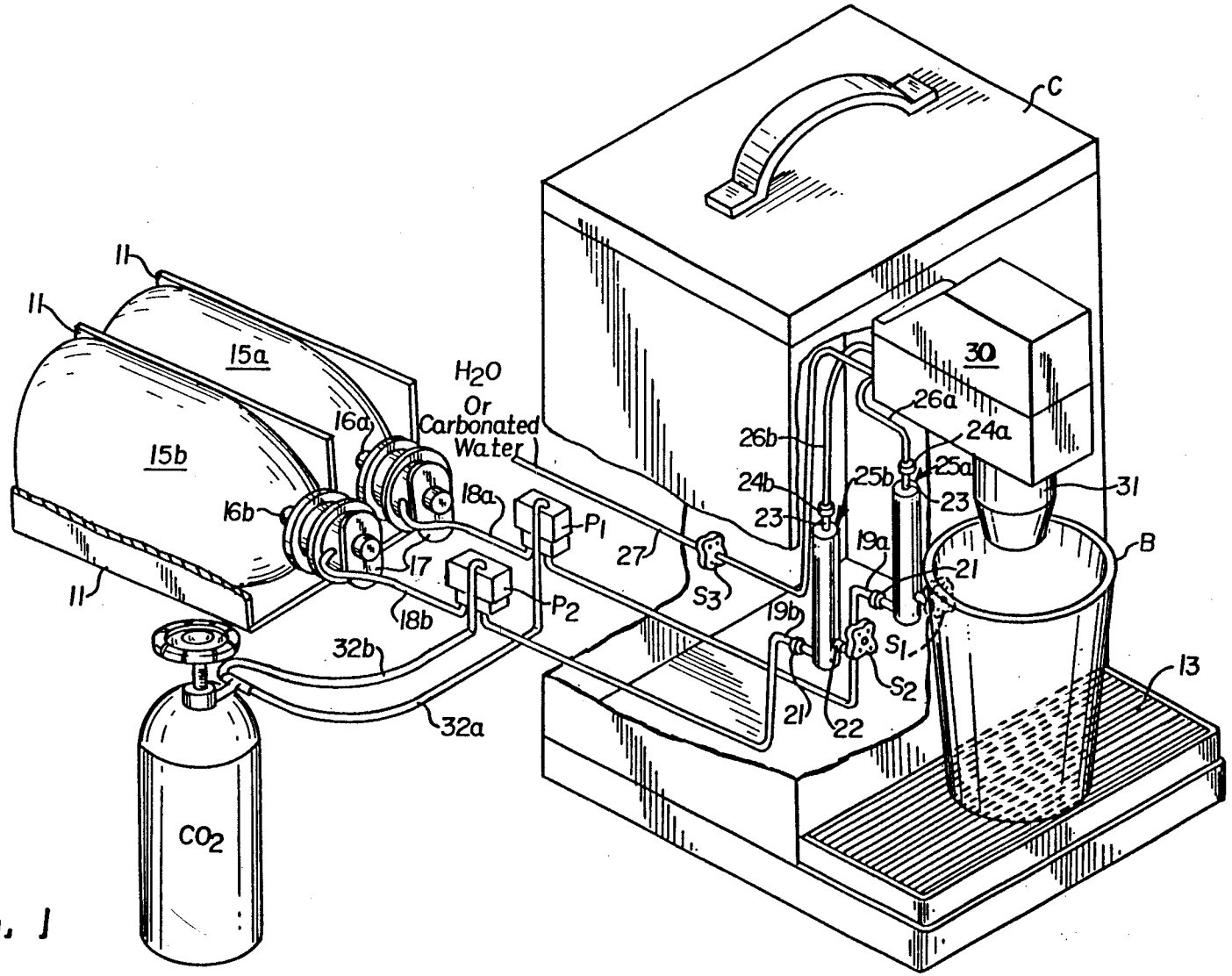
FIG. 1 is a perspective view in elevation illustrating a unitized, compact dispensing station of a relatively simple apparatus arrangement of my invention that may be employed for supplying, proportioning and mixing two or more ingredients with water, which includes, salt-free water or carbonated water at a drink dispensing station.
Figure 2:
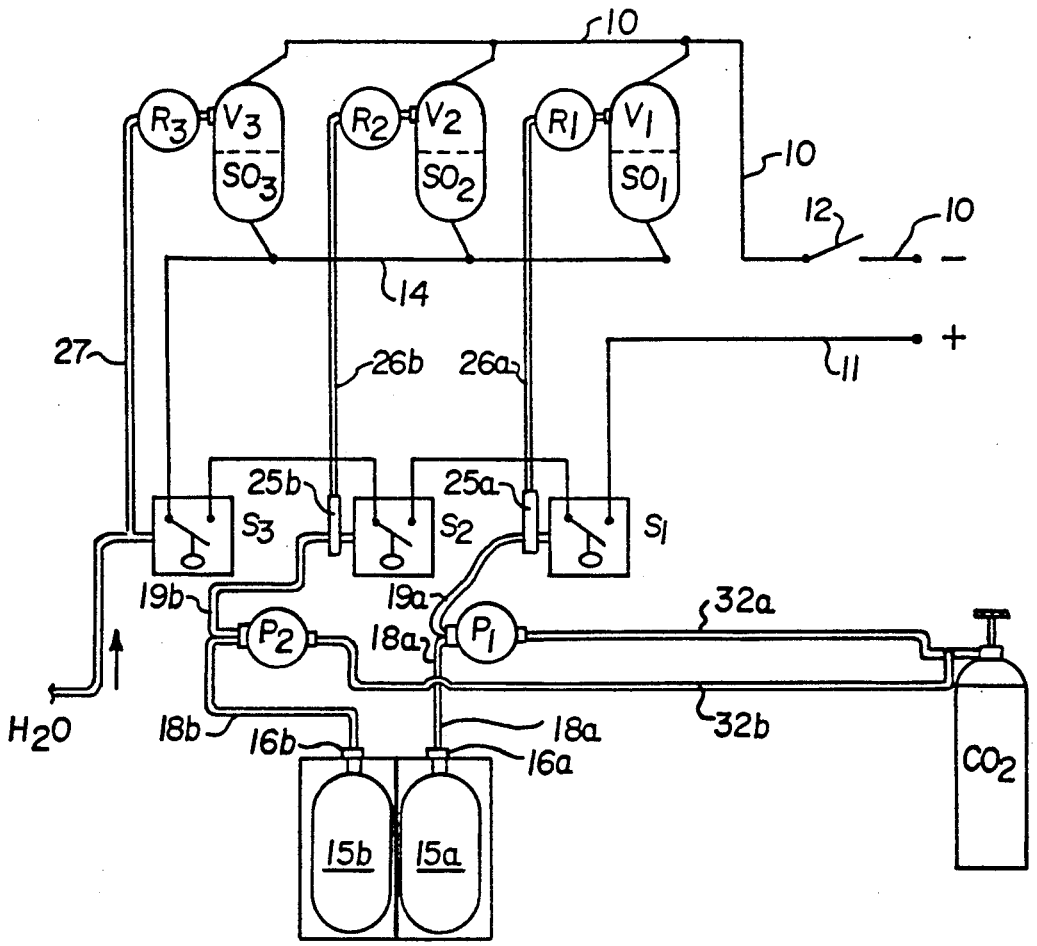
FIG. 2 is a schematic of an operating system layout of my invention which is shown as employing electrical energy for its main functioning parts and gas pressure for operating its fluid pressure pumps.

In carrying out my invention, I have been able to make use of on-the-market units, for example, "Shurflo" fluid-operated pumps $P_1$ and $P_2$, in the system of FIGS. 2, 3 and 4 for separately supplying ingredients, such as a sweetener, a syrup, a flavoring material, etc. to a unitized dispensing assembly 30 (see FIG. 1) that employs regulators $R_1$, $R_2$ and $R_3$ for adjusting the proportioning of each liquid, and individual solenoid operated valves $V_1$, $V_2$ and $V_3$ that are respectively operated by their individual solenoids $SO_1$, $SO_2$ and $SO_3$ for supplying proportioned liquids to a suitable mixing and dispensing nozzle 31. Each valve is spring-biased to close and is opened by its own electric solenoid. As indicated, I have been able to adapt commercially available apparatus in such a manner as to carry out my invention, see for example, a so-called dispensing valve, manufactured and sold by the Cornelius Company of One Cornelius Place, Anoka, Minn. 55303-1592, as its "Gemini" unit. McCans also manufactures a unit that may be adapted for the same type of usage. I have also been able to make use of "Shurflo" so-called "sold-out" switches $S_1$, $S_2$ and $S_3$ for controlling the operation of solenoids $SO_1$, $SO_2$ and $SO_3$ (see FIG. 2). "Shurflo" equipment is manufactured by Shurflo, 1400 Cerritos Avenue East, Anaheim, Calif. 92805. The ingredient containers are strengthened, plastic bags 15*a*, 15*b* that are used with any conventional quick-connect and disconnect, joint sealing coupling 16*a*, 16*b* for ready replacement of each bag when its respective contents have been used-up or exhausted. Such bags are commercially available and may be of an inert, flexible plastic material of suitable size, for example, 2 to 5 or 10 gallons of ingredient content.

In carrying out my invention, I determined that in a compacted unit such as shown in FIG. 1, where flow lines from fluid pumps, $P_1$ and $P_2$ are employed to move liquid ingredients from bags such as 15*a* and 15*b* along relatively short length lines (as in a compact unit), that there is a tendency to cause a jerky, hammer type of operation. This ripple or wave-like fluid pressure action becomes more acute the shorter the fluid supply lines are. I have been able to assure a smooth and positive operation of regulators $R_1$, $R_2$ by devising and installing a pacifying or stabilizing unit 25 in the fluid pressure lines 19*a* and 19*b* between each fluid supplying pump $P_1$ or $P_2$ and an associated pressure-operated electric switch $S_1$ and $S_2$. Although I have not shown the use of such a unit 25 in water supply line 27, one may be used if conditions so warrant.

The stabilizing unit 25 shown in FIG. 5 of the drawings has an upright positioned, enclosed hollow cylinder whose upper chamber portion is filled with a cushioning fluid, such as air, and whose lower chamber portion is filled with the liquid, such as the syrup or flavoring liquid that is being supplied. A lowermost inlet fitting 21 is connected to introduce liquid from an associated bag, such as 15*a* or 15*b*, and a slightly upwardly offset outlet fitting 22 is adapted to apply the liquid to a pressure switch $S_1$ or $S_2$, that, if utilized, is connected to it (see FIGS. 1 and 3). A vertically, centrally extending outlet pipe 23 is shown extending centrally along the inner chamber of the cylindrical-shaped unit 25 and out through its upper through line 26*a* or 26*b* to an associated regulator $R_1$ or $R_2$ of a dispensing assembly (see FIGS. 1, 2, 3, 4 and 3B). The stabilizing unit 25 assures a smoothed-out, positive application of positive to negative fluid pressure transition of actuating force as applied to an associated negative pressure-sensitive and opened switch $S_1$ or $S_2$. In its operation, each stabilizing unit 25 maintains air in its upper cylinder portion and liquid between its liquid ingredient inlet 21 and outlet 22 portions and, is mounted and maintained in a vertically upright position. Although not shown, a stabilizing unit 25 may be used in the water supply line 27 if conditions warrant it.

In FIG. 1, I have shown a complete drink dispensing unit or assembly A which is fully compact and requires electrical power supply and an outside line 27 for receiving water, salt free or carbonated water under normal pressures of, for example, a minimum of about 30 pounds per square inch to a maximum of about 100 pounds per square inch or any industry standard pressure. In this assembly, 15*a* and 15*b* represent filled conventional liquid ingredient source bags, for example, one bag 15*a* may contain a drink syrup and the other bag 15*b*, a liquid sweetener. Pumps $P_1$ and $P_2$ are connected to draw liquids from the bags 15*a* and 15*b* when they are in dispensing positions, with their mouth ends 16*a* and 16*b* connected through quick-change, thumb pressure release, seal-mounted, couplings 17 to tubing or piping lines 18*a* and 18*b*. The respective liquids are moved under negative pressure by pumps $P_1$ and $P_2$ from their containers 15*a* and 15*b* and then under positive fluid pressure by such pumps along lines 19*a* and 19*b* into associated stabilizer units 25*a* and 25*b* (see also FIG. 2). Next, they are moved under positive fluid pressure through lines 26*a* and 26*b* to a dispensing unit assembly 30, wherein the mixing liquids supplied by the lines 26*a* and 26*b* and water supplied by line 27 are each proportioned or regulated by regulators $R_1$, $R_2$ and $R_3$, and moved through their individual valves $V_1$, $V_2$ and $V_3$ which are controlled by their respective solenoids $SO_1$, $SO_2$ and $SO_3$ (see FIG. 2). Finally, the proportioned ingredients are fed into a mixing chamber and dispensing spout assembly 31 for discharge into a cup or container B. As noted, the cup B may be placed on a shelf 13 in alignment to receive the mixed drink as it emerges.

I have thus been able to incorporate all the operating elements of my system in a compact operating dispensing assembly unit assembly illustrated in FIG. 1, by, for the most part, using conventional equipment parts. However, the parts are employed, for the first time, in such a manner in my system, that the problem heretofore outlined has been solved, and in a connected operating relation as to assure a positive, instantaneous stoppage of all fluid supply to mixing chambers of the dispensing unit assembly 30 when, one of the fluid sources, whether for water, for syrup, or for the flavoring liquid or sweetener, etc. is exhausted or disrupted in any manner. This assures that there will be no "bad" or one or more ingredient missing drink mixed and dispensed.

With reference to the schematic of FIG. 2, electric direct current is shown applied from a suitable source to lines 10 and 11 at a voltage suitable for energizing solenoids $SO_1$, $SO_2$ and $SO_3$ of dispensing head assembly 30 (see FIG. 1). The valves $V_1$, $V_2$ and $V_3$ are electrically opened and spring pressure closed. The line 10 may have a conventional, coin or hand operated switch 12 and is shown connected to one side of each valve opening solenoid $SO_1$, $SO_2$ and $SO_3$. The line 11 is connected in series as shown through the terminals of fluid pressure sensitive switches $S_1$, $S_2$ and $S_3$. The pumps $P_1$ and $P_2$ that control the supply of liquids from container bags 15*a* and 15*b* are connected through piping or tubing 19*a*, 19*b* to the switches $S_1$ and $S_2$. The pumps $P_1$ and $P_2$, as shown, are preferably gas-operated through lines 32*a* and 32*b* from a suitable pressurized tank, such as of carbon dioxide ($CO_2$) and are employed to normally draw the liquid contents of bags 15*a* and 15*b* along lines 18*a* and 18*b*, and advance the liquids under pressure along lines 26*a* and 26*b*, through regulators $R_1$ and $R_2$ and valves $V_1$ and $V_2$ into the mixing and dispensing spout part 31 (see FIG. 1).

Water, as plain water, salt-free or carbonated water may be supplied from a suitable source through line 27 to a fluid pressure-sensitive switch $S_3$ and regulator $R_3$ and valve $V_3$ to the head for mixing with the liquid ingredients supplied by the bags 15*a* and 15*b*.

In operation, when one bag 15*a* or 15*b* becomes exhausted or if, for some reason, the water being supplied is shut off, this will cause fluid pressure to decrease as applied to such a switch as $S_1$ (for the bag 15*a*), or $S_2$ (for the bag 15*b*), or as $S_3$ (for the water supply) and thus to open. Since the switches, as shown, are all connected in series in one electric supply line this will automatically cause all the switch-controlled, valve operating solenoids $SO_1$, $SO_2$ and $SO_3$ to be immediately and simultaneously de-energized, to thus cause their respective valves $V_1$, $V_2$ and $V_3$ to open under spring pressure. The entire electrical system is thus de-energized by the opening of any one of the pressure-sensitive switches $S_1$, $S_2$ or $S_3$.

Further, in carrying out the invention and referring particularly to FIG. 2 of the drawings, it will be noted that bags 15*a* and 15*b* may be of much larger size for supplying the mixing ingredients and can thus be located in a separately positioned somewhat remote location, for example, in a cupboard or rack in a separate room with, as shown in FIGS. 3 and 4, their out-supplying lines 18*a* and 18*b*. The pumps $P_1$ and $P_2$ should be located in close proximity to the containers 15*a* and 15*b* for best results. Typical bags 15*a* and 15*b* are made of a suitable inert material and tend to collapse as they are emptied. I utilize the tendency for negative pressure build-up when a bag is emptied to cause the associated pressure-sensitive switch $S_1$, $S_2$ to open. The same result follows if the water pressure drops due to its shut-off, thus causing pressure-sensitive switch $S_3$ to open.

Again referring to FIG. 2, the liquid content of each bag 15*a*, 15*b*, etc., is normally drawn out through tubing or piping 18*a*, 18*b* by pressure pumps $P_1$ and $P_2$ which are shown as gas-operated through pipe or tubing 32*a* and 32*b* that is connected to a suitable source of pressurized gas such as a carbon dioxide, $CO_2$ tank. There are also electric pumps on the market which may serve the same purpose. The liquid content supplied to the pumps $P_1$ and $P_2$ is then shown as passed along lines 19*a*, 19*b* through its associated stabilizing unit or cylinder 25*a* or 25*b* (25 of FIG. 5) to an associated pressure-sensitive electric switch $S_1$ or $S_2$. The liquid ingredient enters each stabilizing unit 25 through its inlet connection 21 and out through centrally extending "down" pipe or tubing member 23 and outlet connection 24, and through piping 26*a* and 26*b* (see FIG. 2) to an associated regulator $R_1$ and $R_2$ which has means for adjusting the proportioning of each ingredient. Each ingredient is then supplied to the mixing chamber of the dispensing unit 30 through individual solenoid-controlled ingredient valves $V_1$ and $V_2$ while water or carbonated water is supplied from a suitable conventional source, such as a municipal system, as regulated by a conventional flow meter, and as shown in FIG. 2, is passed through line 27, regulator $R_3$ solenoid-controlled dispensing valve $V_3$ to the same mixing chamber. The regulators $R_1$, $R_2$ and $R_3$, the dispensing valves $V_1$, $V_2$ and $V_3$ as controlled by electric solenoids $So_1$, $So_2$ and $So_3$, the mixing chamber, etc. are all available in a typical commercial unit 30, 31, such as a Cornelius Gemini unit. I have found it preferable to provide a smaller pass-through hole in a conventional regulator in order to enable a suitable "down" adjustment of the percentage of each liquid (sweetener, syrup, etc.) as individually supplied to the mixing chamber. This is in contrast to one system now in use, where both the syrup and sweetener are supplied to a regulator as a pre-mixed liquid. I obviate the need to provide a proportioning best suited to minimizing adverse effects inherent in using a pre-mix, e.g., the need for an excessive amount of sweetening liquid. I now am able to, in accordance with my invention, provide a better mixed drink product, since we can blend whatever ratio is required by the manufacturer of syrup or sweetener by changing the regulator pass through hole diameter.

The pressure switches $S_1$ and $S_2$ are set to remain closed when fluid pressure is normal during the withdrawing of liquid from each bag 15*a* or 15*b*, but are opened when vacuum or negative pressure increases due to a failure or exhaustion of the liquid content of a given bag. The switch $S_3$ is set to remain closed when water is being supplied at normal pressure and to open when, for example, its supply is shut off. If desired, the switch $S_3$ may be eliminated, since the exhaustion of the bags 15*a* and 15*b* is a more normal occurrence. It will be noted that if any one of the switches $S_1$, $S_2$ or $S_3$ is thus opened (see FIG. 2), then the in-series electrical lines 11 and 14 are opened and all the solenoids $SO_1$, $SO_2$ and $SO_3$ are simultaneously de-energized to thus simultaneously close their associated liquid supply valves $V_1$, $V_2$ and $V_3$, such that no liquid at all will be fed into the mixing chamber of unit 31 and thus, none will thereafter be fed to the container B. I have found that in addition to their pressure sensitive switches, "Shurflow" so-called high performance gas operated demand pumps work satisfactorily in my system. This Company is located at 1400 Cerritos Avenue East, Anaheim, CA 92805.

Figure 3A:
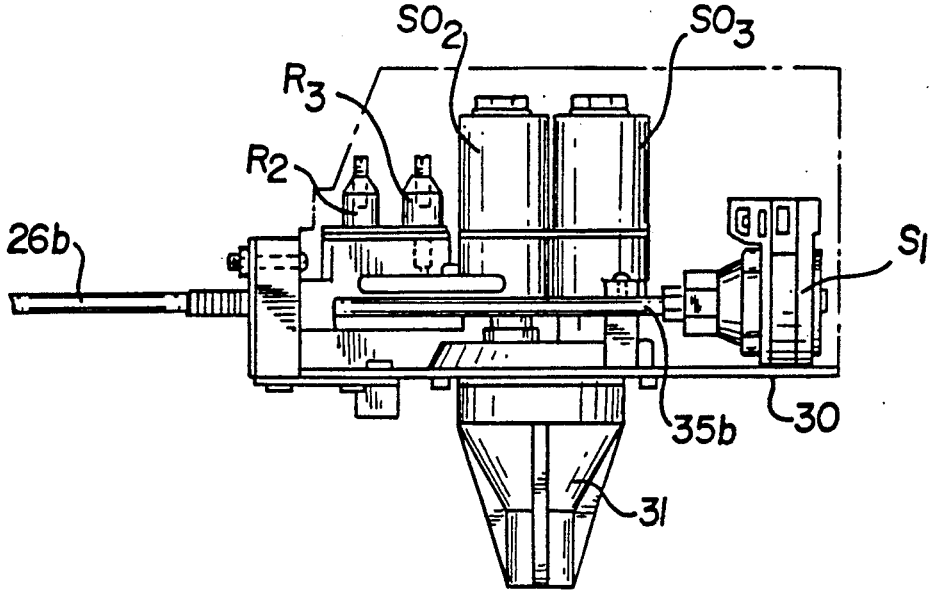
FIG. 3A is a further enlarged vertical side view and FIG. 3B is a top plan view on the same scale, particularly illustrating a solenoid valve assembly and switches mounted in the dispensing assembly instead of elsewhere in the system as illustrated in FIGS. 3 and 4.
Figure 3B:
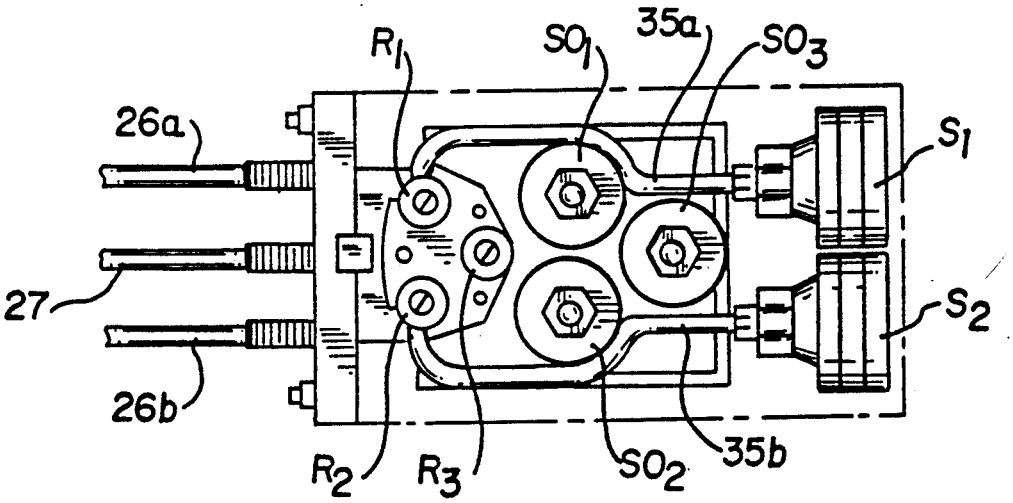

In FIGS. 3A and 3B, I have shown the switches $S_1$ and $S_2$ as directly connected by fluid lines 35*a* and 35*b* to the inlet side of regulators $R_1$ and $R_2$, as may occur if the fluid lines 26*a* and 26*b*, that are connected to the switches, are of an extended length, such that the stabilizing units 25*a* and 25*b* may be omitted. Switches will be used even if the stabilizers are not. Also, the switches, as an alternative, can be mounted in the dispensing unit assembly or head 30 for providing further compactness.

What is claimed is:

1. An improved beverage system for mixing liquid ingredients including water in such a manner as to always assure a desired suitable proportioning of the ingredients in a beverage being dispensed which comprises, individual sources for each ingredient, a mixing chamber, individual valve means for controlling feed of each ingredient into said mixing chamber, means connecting each of said sources to its valve means, means actuated by an exhausting of any one of said sources of its ingredients for simultaneously closing all of said valve means, pump means for said connecting means to withdraw ingredients from their said sources and for then moving each ingredient under positive fluid pressure to its said valve means, a pressure sensitive electric switch connected to each of said connecting means, each said valve means has an electrically energized solenoid for when energized to hold said valve means in an open position, a source of electric current connected through each of said switches to an associated one of said solenoids, each of said switches being constructed to move to an open position when positive fluid pressure in any one of said connecting means decreases due to the exhaust of an associated one of said sources of ingredients, said switches being electrically connected in such a manner with respect to each other and with respect to said solenoids as to de-energize all of said solenoids when any one of said switches is moved to an open position, and regulator means operatively connected between each said switch and an associated said valve means for controlling the amount of the ingredient being supplied to the associated said valve means to thus proportion the ingredient with respect to other of said ingredients being supplied to said mixing chamber.

2. A system as defined in claim 1, wherein stabilizer means is operatively connected between at least one of said ingredient sources and an associated said regulator means to assure a smooth flow of the ingredient being supplied thereto.

3. A system as defined in claim 2, wherein said stabilizing means also has means operatively connecting it between said ingredient source and an associated said switch.

4. An improved beverage dispensing system for mixing liquid ingredients including water in desired proportioned amounts and then dispensing them as a suitable mixed drink which comprises, individual sources for each ingredient, a common mixing chamber for the ingredients, individual electric solenoid-controlled valve means for supplying each ingredient to said mixing chamber, regulator means for supplying a proportioned amount of each ingredient to an associated one of said valve means, means for supplying each ingredient from an associated one of said sources under pressure to an associated one of said regulator means, individual liquid pressure controlled electrical switches, each of said switches being electrically connected to an associated one of said solenoid controlled valve means for closing it and being electrically connected with respect to the other of said switches to close all of said solenoid-controlled valve means when any one of said ingredient sources fail.

5. A system as defined in claim 4, wherein a group of said ingredient sources comprises a container for a sweetener and a container for a syrup, pump means is provided for drawing the sweetener and the syrup out of their respective containers and then moving them under positive fluid pressure to an associated one of said switches to maintain it in a closed position as long as there is a sufficient amount of the liquid ingredient in the container and also to apply a lessened fluid pressure to said switch and open it when the liquid ingredient in the container becomes exhausted.

6. A system as defined in claim 5 wherein, stabilizing means is provided for liquid being supplied by said pump means from said containers to associated electrical switches and to said regulator means.

7. A system as defined in claim 6, wherein said stabilizing means comprises, a vertically positioned container that is partially filled with the liquid being supplied by said pump means, that has an inlet located below the liquid level therein and connected to receive the liquid from an associated said pump means, that has an outlet also located below such liquid level and connected to apply the liquid to an associated one of said pressure switches, that has an air space therein above the liquid level, and that has a down pipe extending longitudinally from its upper end into the liquid therein; said down pipe being connected to an associated one of said regulators for supplying the liquid from said stabilizing means thereto.

8. An improved beverage dispensing system for mixing liquid ingredients from two or more sources in desired proportions at a beverage dispensing station and for assuring a complete stoppage of the mixing operation when the content of one of the sources becomes exhausted to thus avoid supplying a beverage lacking a fully proportioned desired content which comprises: a source of water, a dispensing unit having means for connecting it to at least two different liquid ingredient supplying containers to, when mixed with water, provide a desired complete beverage content, regulator means and a solenoid-operated valve for the water and for each of the liquid ingredients mounted on said unit, a drink mixer and an associated mixed drink dispenser mounted on said unit, a fluid pump for supplying each liquid ingredient from the containers to an associated one of said regulator means and solenoid-operated valves, means for supplying water to said unit, fluid pressure-sensitive electric switches mounted on said dispensing unit and each connected to an associated said solenoid-operated valve for de-energizing and closing each of said valves, and means operatively connecting said switches to each of the liquid ingredient sources and to the water source to activate at least one of said switches and close all of said valves when the liquid supply from any of the sources becomes deficient.

* * * * *

UNITED STATES PATENT AND TRADEMARK OFFICE

CERTIFICATE OF CORRECTION

PATENT NO. : 5,082,143

DATED : January 21, 1992

INVENTOR(S) : WILLIAM L. SCHRAMM, JR.

It is certified that error appears in the above-identified patent and that said Letters Patent is hereby corrected as shown below:

Column 4, line 4, after "upper", --end which has a threaded fitting 24 for connecting it-- should be inserted.

Column 5, line 29, after "supply line", --11,-- should be inserted.

Claim 1, column 7, line 17, "exhaust" should be --exhausting--.

Signed and Sealed this

Nineteenth Day of July, 1994

Bruce Lehman

*Attest:*

BRUCE LEHMAN

*Attesting Officer*

*Commissioner of Patents and Trademarks*